US008911120B2

(12) United States Patent
Dalsgaard et al.

(10) Patent No.: US 8,911,120 B2
(45) Date of Patent: Dec. 16, 2014

(54) LIGHT BEAM FRAMING SYSTEM WITH MERGED SHUTTER BLADES

(75) Inventors: Carsten Dalsgaard, Silkeborg (DK); Morten Grønberg, Skødstrup (DK)

(73) Assignee: Martin Professional ApS, Aarhus, N. (DK)

( * ) Notice: Subject to any disclaimer, the term of this patent is extended or adjusted under 35 U.S.C. 154(b) by 294 days.

(21) Appl. No.: 13/522,387

(22) PCT Filed: Jan. 14, 2011

(86) PCT No.: PCT/DK2011/050009
§ 371 (c)(1), (2), (4) Date: Oct. 2, 2012

(87) PCT Pub. No.: WO2011/085732
PCT Pub. Date: Jul. 21, 2011

(65) Prior Publication Data
US 2013/0039075 A1 Feb. 14, 2013

(30) Foreign Application Priority Data
Jan. 18, 2010 (DK) ..... 2010 00034

(51) Int. Cl.
*F21V 17/02* (2006.01)
*F21V 14/08* (2006.01)
*F21V 11/18* (2006.01)
*F21W 131/406* (2006.01)

(52) U.S. Cl.
CPC ..... *F21V 14/08* (2013.01); *F21W 2131/406* (2013.01); *F21V 11/183* (2013.01)
USPC ..... 362/321; 362/281; 362/319; 362/324; 396/471; 396/501; 396/510

(58) Field of Classification Search
USPC ..... 362/16–18, 277, 280, 281, 319, 362/321–324; 396/449, 452, 471, 493–501, 396/510
See application file for complete search history.

(56) References Cited

U.S. PATENT DOCUMENTS 4,416,527 A * 11/1983 Okura ..... 396/509
5,043,753 A * 8/1991 Nakamori ..... 396/449
(Continued)

FOREIGN PATENT DOCUMENTS

WO WO96/36834 5/1996

OTHER PUBLICATIONS

International Search Report; International Application No. PCT/DK2011/050009; International Filing Date: Jan. 14, 2011; 10 pages.
(Continued)

*Primary Examiner* — Hargobind S Sawhney
(74) *Attorney, Agent, or Firm* — Blank Rome LLP

(57) ABSTRACT

The present invention relates to a framing system for shaping a light beam. The framing system comprises a frame support comprising a number of shutter blades surrounding said light beam and a number of actuators adapted to move said shutter blades in and out of said light beam. The shutter blades form a merged pile, where part of a first shutter blade is in placed over a part of a second shutter blade and where another part is placed below a part of a third shutter blade. A first actuator rotates at least one of said shutter blades in relation to a first rotational point and a second actuator moves the first rotational point in relation to said light beam. The present invention relates further to a method of shaping a light beam comprising the steps of rotating a shutter blade around a first rotation point using a first actuator and moving the first rotation point in relation to the light beam using a second actuator.

13 Claims, 8 Drawing Sheets

(56) References Cited

U.S. PATENT DOCUMENTS

| | | | | |
|---|---|---|---|---|
| 5,537,166 | A * | 7/1996 | Keelan et al. | 353/97 |
| 5,904,417 | A * | 5/1999 | Hewett | 362/321 |
| 6,811,331 | B2 * | 11/2004 | Iwasa | 396/500 |
| 6,853,810 | B1 * | 2/2005 | Fujinaga | 396/269 |
| 7,259,922 | B2 * | 8/2007 | Fukasawa | 359/738 |
| 7,287,864 | B2 * | 10/2007 | Shirasu et al. | 353/97 |
| 7,677,740 | B2 * | 3/2010 | Takeuchi et al. | 353/97 |
| 8,057,113 | B2 * | 11/2011 | Kawamoto | 396/493 |
| 2006/0290901 | A1 * | 12/2006 | Moriyama et al. | 353/97 |

OTHER PUBLICATIONS

Written Opinion; International Application No. PCT/DK2011/050009; International Filing Date: Jan. 14 2011; 8 pages.

* cited by examiner

LIGHT BEAM FRAMING SYSTEM WITH MERGED SHUTTER BLADES

FIELD OF THE INVENTION

The present invention relates to a framing system for limiting/shaping a light beam and to light fixtures comprising such framing system.

BACKGROUND OF THE INVENTION

Framing systems for shaping a light beam where a number of shutter blades are moved in and out of the light beam in order to adjust the shape of the beam have been known for many years.

Typical framing systems have a number of shutter blades which can be moved in and out of the light beam by a number of actuators. The light beam is shaped/delimited/framed by adjusting the position of each shutter blade relatively to the light beam and thereby achieving the wanted framing of the light beam. The framing systems are typically used in light fixtures such as moving heads, follow spots and spotlights generating a light beam. Such light fixtures comprise a light source generating a light beam and a number of optical components generating different optical effects.

WO9636834, WO03023513, WO07134609, disclose framing systems according to prior art where a number of shutter blades surrounds the light beam and can be moved in and out of the light beam by a number of actuators. The shutter blades and actuators are mounted on a frame support rotatable carried by a base support. These framing systems are used in light fixtures having a light source generating a light beam, a lens system for focusing and/or zooming the light beam and controlling means (CPU; microprocessors, microcontrollers, PLD or the like) for controlling the components of the light fixture. The framing systems according to WO9636834 and WO03023513 do not from a sharp image of the shutter blades when projected onto a target surface by an optical system and do also take up a lot of space inside the light fixture, as the shutter blades are positioned in at least two different planes.

WO07134609 tries to solve this by providing a light assembly comprising at least one light source for generating a beam of light and a framing system. The framing system comprises a number of shutter blades cooperating with a number of motors to move the shutter blades in and out of the light beam. The shutter blades form a merged pile, where the shutter blades in the merged pile are placed with the front area placed over the front area of a first neighboring shutter blade and the front area placed below the front area of the second neighboring shutter blade. Forming the shutter blades in a merged pile leads to a thin assembly, where the operating edges of the shutters are operating substantially in the same plane. The shutter blades are movable mounted and co-operates with motors to move the shutter means in and out of the light beam. The shutter blades comprise a front end to delimit the beam of light and the two toothed sides and interacting with pinions on the motors. One motor is placed in a fixed position, and second motor is movable in a sideward direction. The two motors allow movement and adjustment of the individual shutter blades in order to delimit the light beam.

The framing system disclosed in WO07134609 is however not very useful as it is very hard to manufacture. The toothed sides of the framing blades tend to break during use, epically during longtime use. The shutter blades must further be moved in a very controlled manner, as the shutter blades can be move in and out the merged pile causing crucial failure of the framing system. This can for instance occur if the corners of two adjacent shutter blades are moved too far away from each other, which results is in fact the that shutter blades gets mixed up and will not work properly. It is possible through the software or by introducing mechanicals stops to limit this movement but this will also limit the framing system's flexibility and degree of freedom.

DESCRIPTION OF THE INVENTION

The object of the present invention is to solve the above described limitations related to prior art framing systems. This is achieved by a framing system, light fixture and method as described in the independent claims. The dependent claims describe possible embodiments of the present invention. The advantages and benefits of the present invention are described in the detailed description of the invention.

DESCRIPTION OF THE DRAWING

FIG. 5*a* is an exploded perspective view, 5*b* is a front view of showing only one shutter blade and FIG. 5*c* is a front view excluding the top plate;

DETAILED DESCRIPTION OF THE INVENTION

Figure 1:
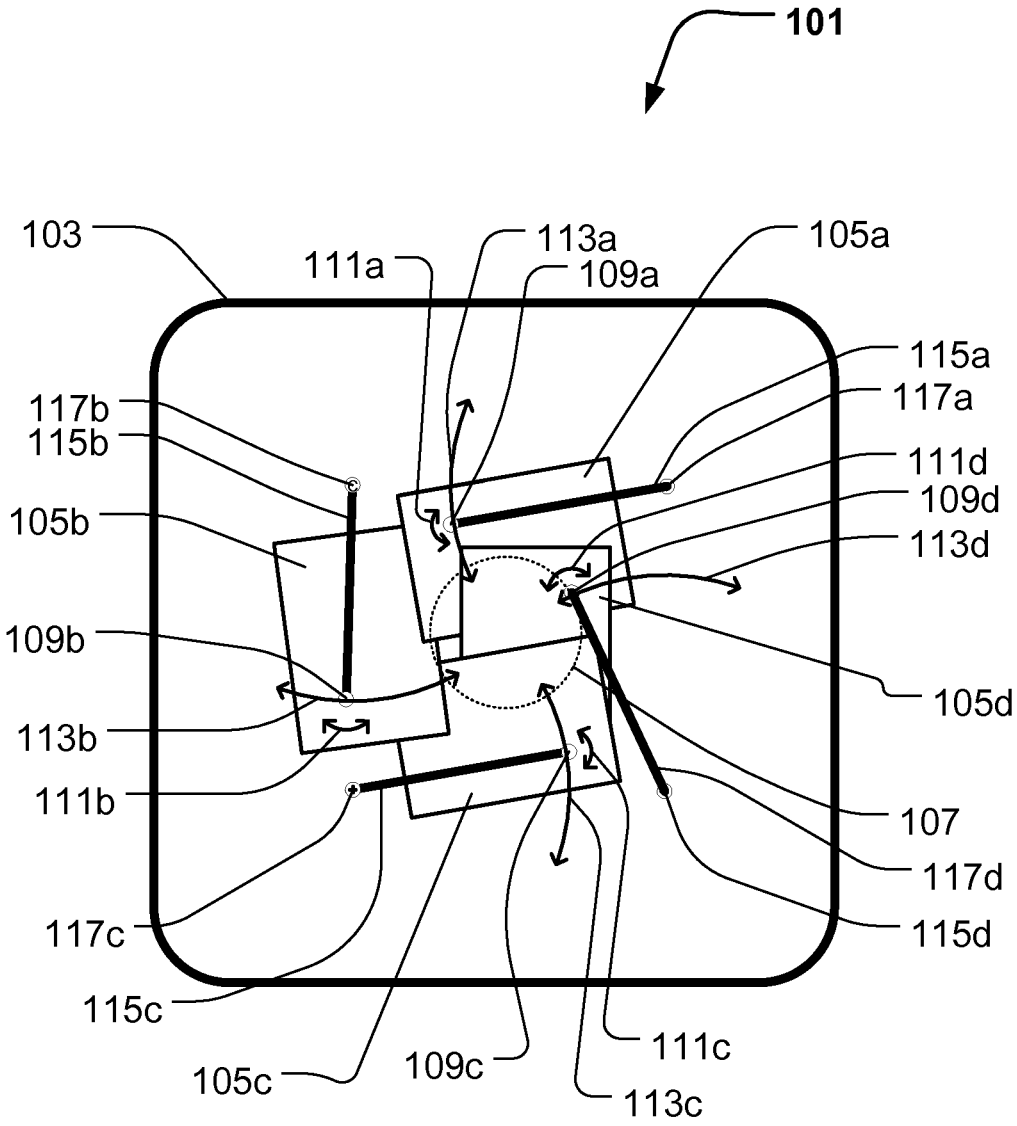
FIG. 1 illustrates a top view of a framing system according to the present invention.

FIG. 1 illustrates a top view of a framing system 101 according to the present invention. The framing system 101 comprises a frame support 103. The frame support comprises a number of shutter blades 105*a*-105*d* surrounding an aperture 107 where through a light beam (not shown) propagates. A number of actuators (not shown in FIG. 1) are adapted to moved the shutter blades in and out of the aperture 107 and thus also in and out of the light beam the light beam. The shutter blades are each moved in and out of the light beam by two actuators (not shown in FIG. 1) where a first actuators rotates the shutter blade in relation to a first rotational point 109*a*-109*d* as illustrated by arrows 111*a*-111*d*, and where a second actuator moves the first rotational point 109*a*-109*b* in relation to the light beam as illustrated by arrows 113*a*-113*d*.

This setup makes it possible to construct a very flexible framing system with a large degree of freedom; meaning that each shutter blade can be positioned in many different positions and than the light beam can be shaped in many different shapes. The framing blades can in this embodiment be moved over the entire area of the aperture and angled at any angle. Shutter blade 105*d* is, in the illustrated framing system 101, for instance nearly moved across the entire aperture 107 whereas shutter blade 105*b* only covers a small part of the aperture. The consequence is that a light beam passing through the aperture can be shaped in large many different shapes. It is further possible to merge the framing blades in a pile where at least a part of a first shutter blade is in placed over at least a part of a second shutter blade and where at least a part of the first shutter blade is placed below at least a part of a third shutter blade. The shutter blades are hereby positioned in substantially the same plane whereby it is possible to provide a very sharp image of the shutter blades at a target surface a distance from the framing system. The image can for instance be constructed by using an optical system as known in the art. It is further possible to form the shutter blades such that they can not be mixed up in any position and simultaneously maintain a very flexible framing system.

The shutter blades 105*a*-105*d* comprise in the illustrated embodiment a first arm 115*a*-115*d* pivotally connected to the first rotational point 109*a*-109*d* and pivotally connected to the frame support at a frame pivot point 117*a*-117*d*. The second actuator moves the first rotational point by pivoting first arm 115*a*-115*b* around the frame pivot point 117*a*-117*d*. This makes it possible to reduce the size of the framing system, as the shutter blades, due the fact that the shutter blade can move below the arm of neighboring shutter blades, can be positioned very close together.

Figure 2A:
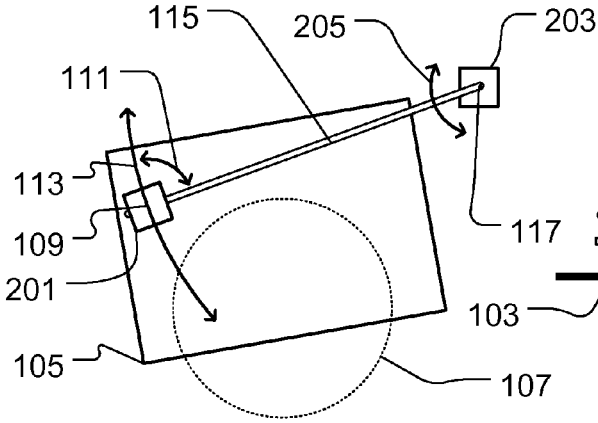
FIG. 2*a* illustrates a top view and FIG. 2*b* illustrates a side view of an embodiment of a single shutter blade.
Figure 2B:
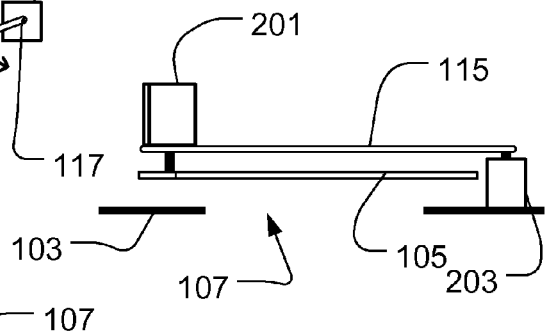

FIG. 2*a* illustrates a top view and FIG. 2*b* illustrates a side view of an embodiment of a single shutter blade 105 and illustrates how the first actuator 201 can rotate the shutter blade around the first rotational point 109 and how the second actuator 203 can move the first rotational point 109 in relation to the light beam which propagates through the aperture 107. The first actuator 201 is in this embodiment mounted on the first arm 115 and is coupled to the first rotational point of the shutter blade 109 through an axis. The first actuator 201 can thus rotate the shutter blade around the first rotational point as indicated by arrow 111. The second actuator 203 is mounted on the frame support 103 and connected to the first arm 115 through an axis. The first rotational point 109 is fixed in relation the first arm and the second actuator 203 can thus move the first rotational point in relation to the light beam as illustrated by arrow 113 by rotating the first arm as indicated by arrow 205. The second actuator is illustrated as a rotational actuator which moves the first rotational point in relation to the light beam by a rotating movement, but the skilled person realize that the second actuator also can any kind of actuator moving the first arm, e.g. a linear actuator which pushes/pulls the first rotation point in relation to the light beam.

Figure 3A:
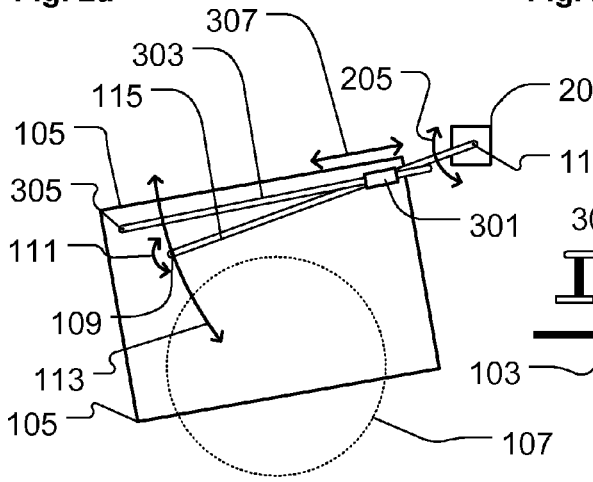
FIG. 3*a* illustrates a top view and FIG. 3*b* illustrates a side view of another embodiment of a single shutter blade.
Figure 3B:
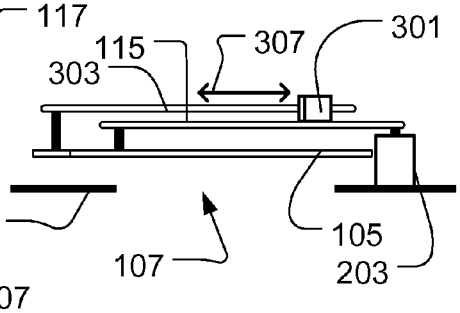

FIG. 3*a* illustrates a top view and FIG. 3*b* illustrates a side view of another embodiment of a single shutter blade 105. The second actuator 203 can move the first rotational point 109 in relation to the light beam which propagates through the aperture 107 in a similar way as described in FIG. 2*a* and FIG. 2*b*. The shutter blade comprises in this embodiment a second arm 303 pivotally connected to the shutter blade at a blade pivot point 305 offset the first rotational point 109 and first actuator 301 rotates the shutter blade by interacting with said second arm. The first actuator 301 is in the illustrated embodiment as a linear actuator mounted on the first arm 115. The linear actuator 301 is adapted to move the second arm in a linear direction as illustrated by arrow 307 and the second arm will as a consequence push/pull the blade pivot point in relation to the first rotational point, whereby the shutter blade is forced to rotate in relation to the first rotational point 119 as illustrated by arrow 111. The first actuator can also be a rotational actuator adapted to rotate the second arm 303 and can also be positioned on the frame support. The second actuator 301 can also be adapted rotate in relation to the first arm in order to eliminate the mismatch between linear movement of the second arm an the rotation of the blade pivot point 305 around the first rotational point 109.

Figure 4A:
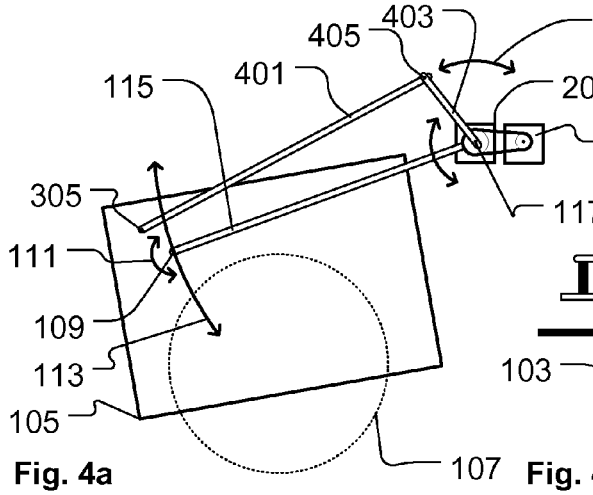
FIG. 4*a* illustrates a top view and FIG. 4*b* illustrates a side view of another embodiment of a single shutter blade.
Figure 4B:
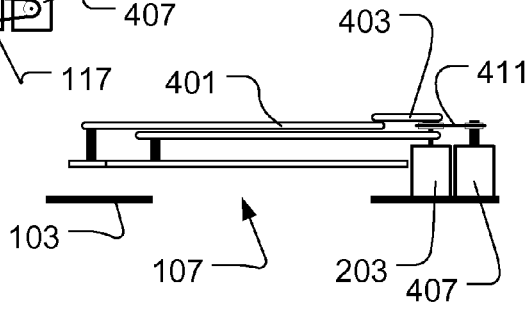

FIG. 4*a* illustrates a top view and FIG. 4*b* illustrates a side view of another embodiment of a single shutter blade 105. The second actuator 203 can move the first rotational point 109 in relation to the light beam which propagates through the aperture 107 in a similar way as described in FIG. 2*a* and FIG. 2*b*. The second arm comprises in this embodiment a first part 401 and a second part 403 pivotally interconnected at an arm pivot point 405. The first part 401 is pivotally connected to the blade pivot point 305 and the second part is pivotally connected to the frame pivot point. The first actuator 407 is adapted the move the arm pivot point 405 in relation to the frame pivot point 117 as illustrated by arrow 409 whereby the first arm 401 pushes/pulls the blade pivot point 305 causing the shutter blade to rotate around the first rotational point 109 as illustrated by arrow 111. This is in the illustrated embodiment achieved by coupling the second arm 403 rotatable to the axis of the second actuator using a center gear and driving the center gear by the first actuator for instance through a belt 411 coupling as illustrated or another mechanical coupling. The second arm can alternatively be coupled to a second frame pivot point which is offset the frame pivot point 117.

Figure 9A:
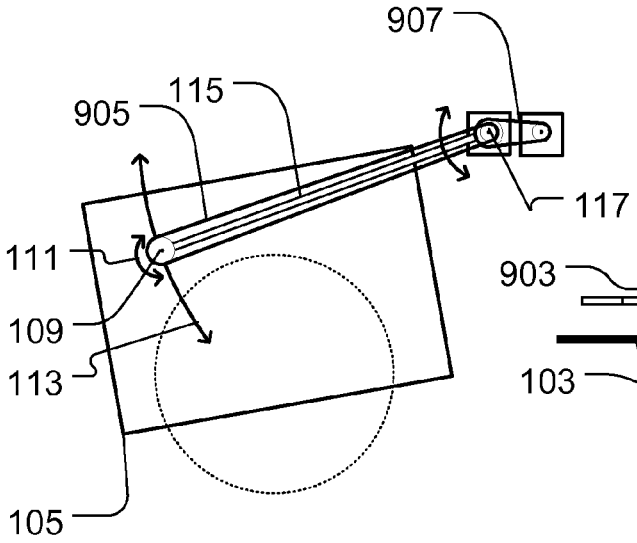
FIG. 9*a* illustrates a top view and FIG. 9*b* illustrates a side view of another embodiment of a single shutter blade.
Figure 9B:
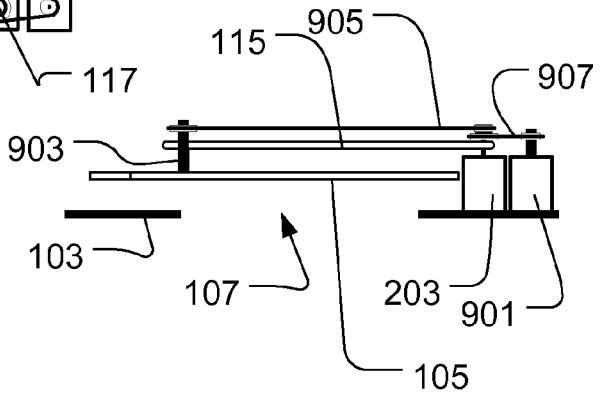

FIG. 9*a* illustrates a top view and FIG. 9*b* illustrates a side view of another embodiment of a single shutter blade 105. The second actuator 203 can move the first rotational point 109 in relation to the light beam which propagates through the aperture 107 in a similar way as described in FIG. 2*a* and FIG. 2*b*. The first actuator 901 is in this embodiment coupled to an axis 903 through the first rotational point 109 and the first arm 105 using rotation belt 905 rotatable coupled to the axis of the second actuator 203, a center gear coupled to the rotation belt 905 and a driving belt 907 coupled the first actuator and the center gear. The belt coupling will cause the shutter blade 105 to rotate around the first rotational point 109 as illustrated by arrow 111 when the actuator interacts with the belt coupling.

Figure 5A:
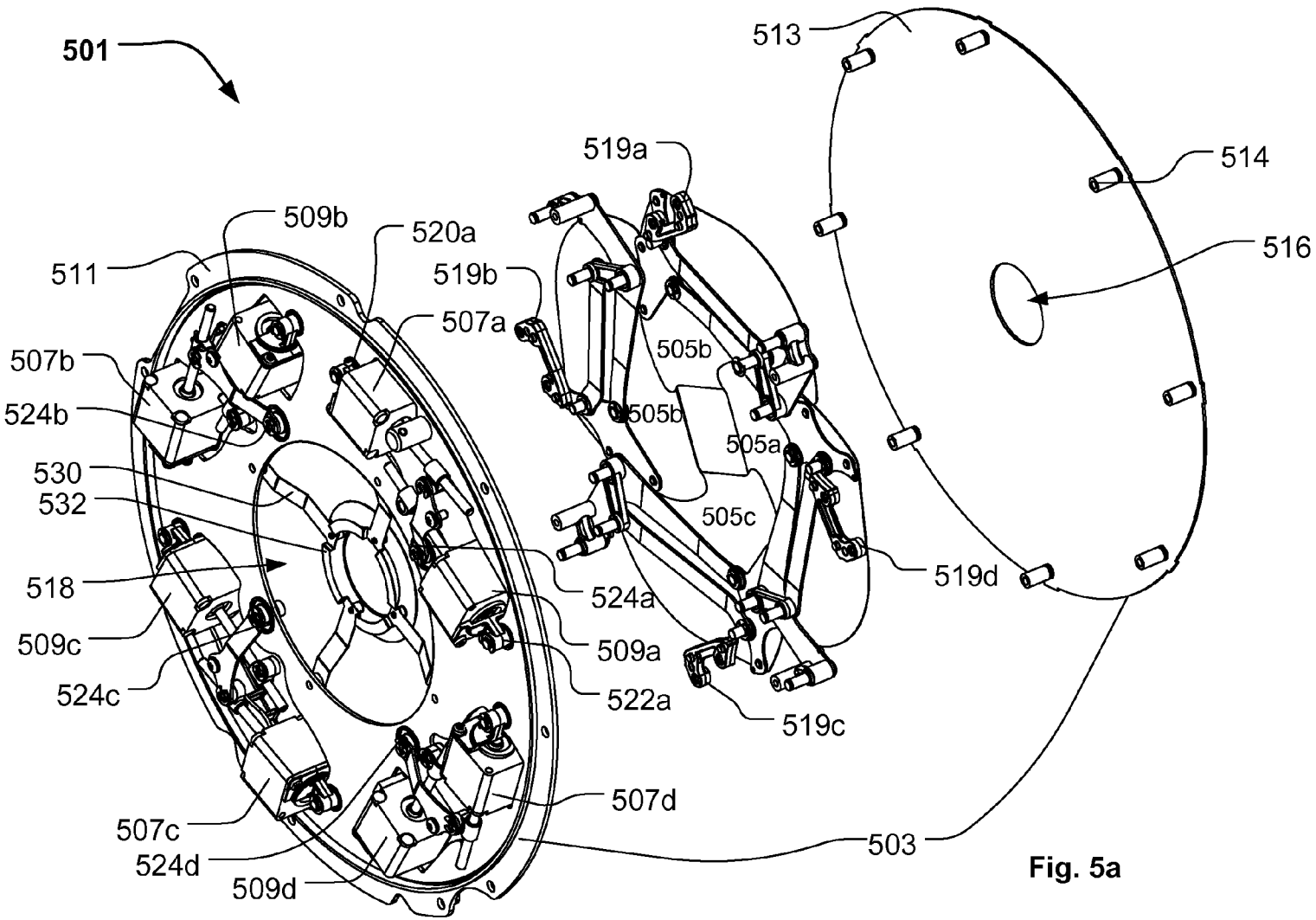
FIG. 5*a*-5*c* illustrate another embodiment of the framing system according to the present invention, where
Figure 5B:
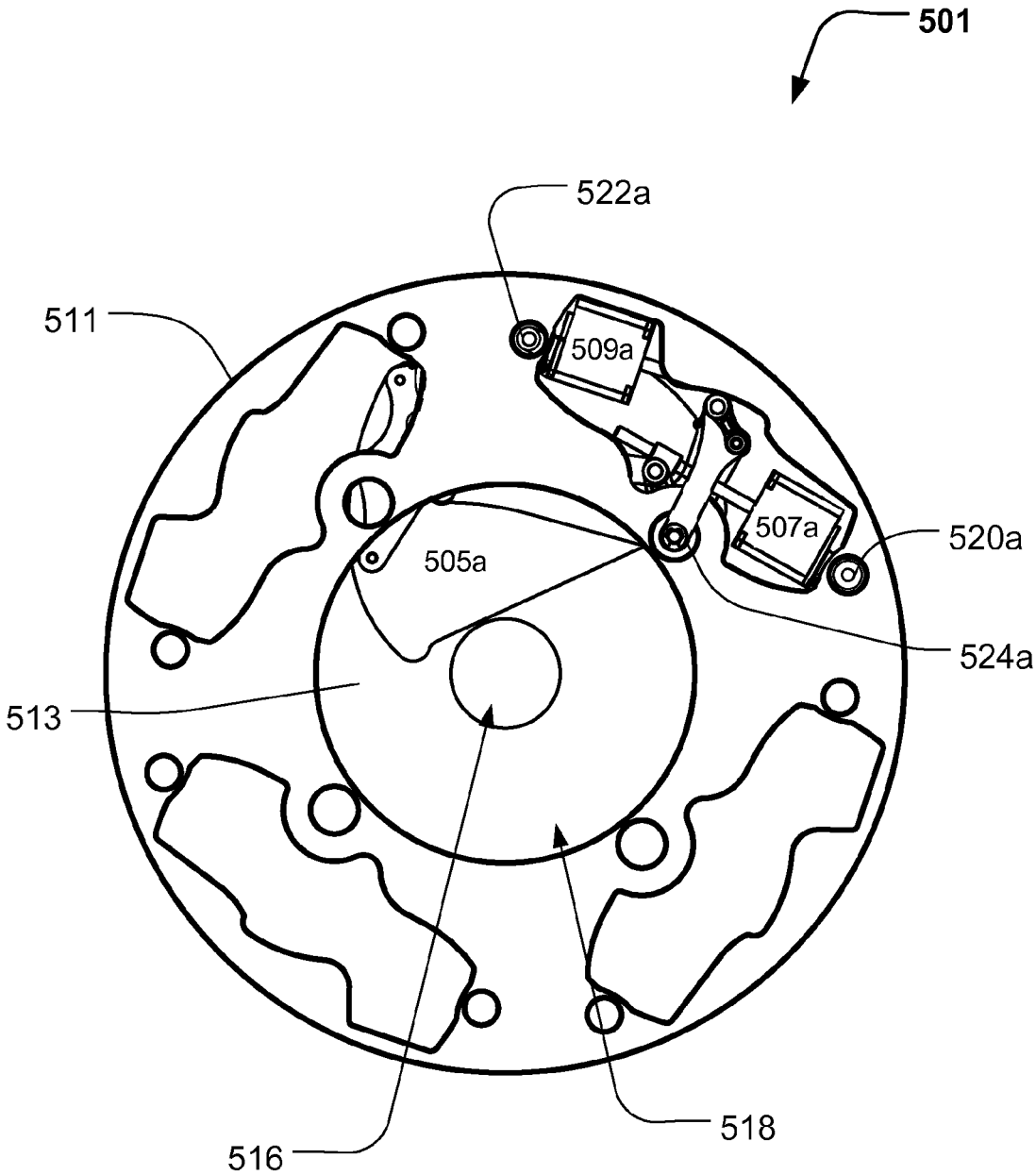
Figure 5C:
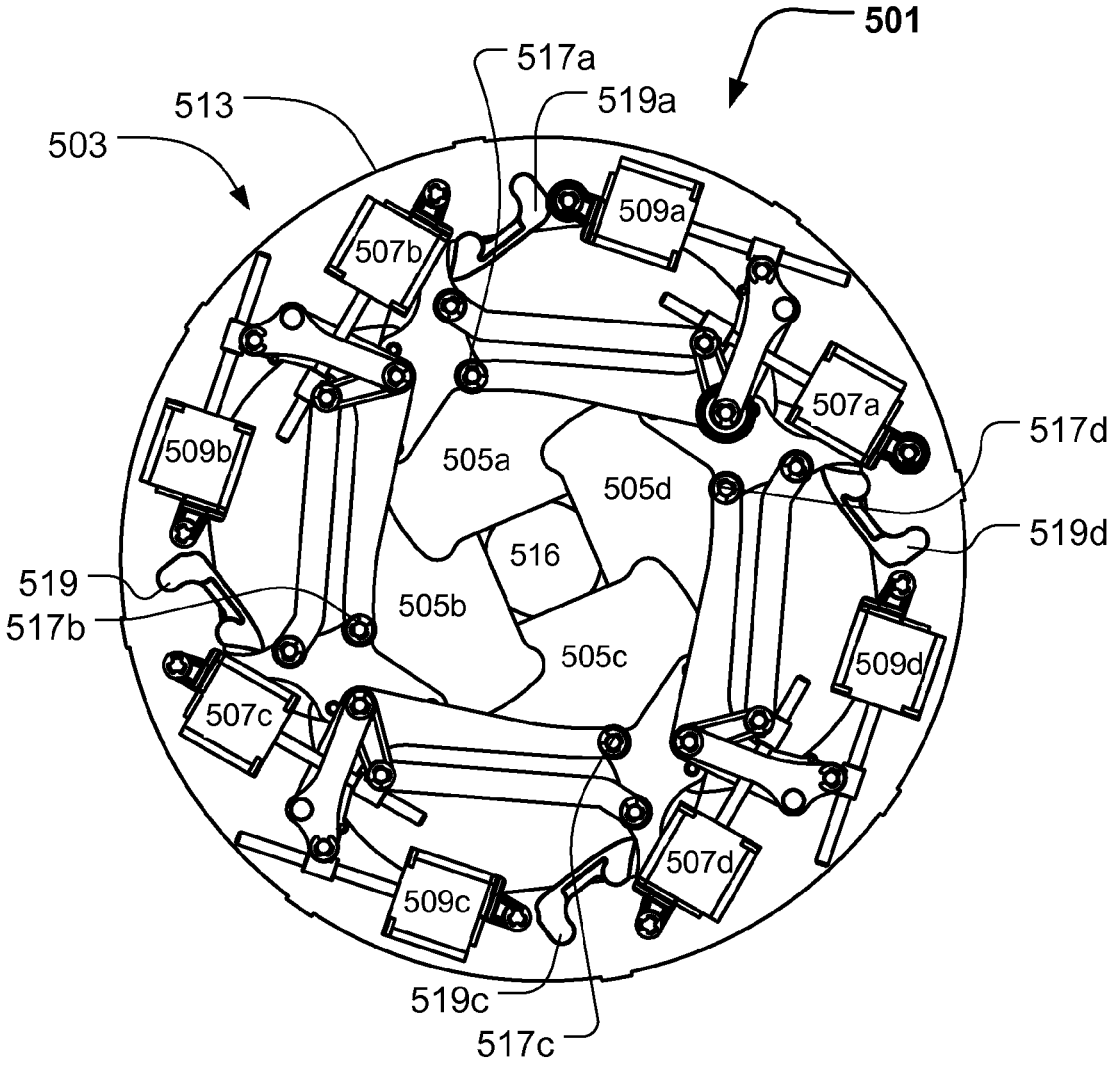

FIG. 5*a*-5*c* illustrate another embodiment of the framing system 501 according to the present invention, where FIG. 5*a* is an exploded perspective view, 5*b* is a front view showing only shutter blade 505*a* and FIG. 5*c* is a front view without the top plate. The framing system 501 comprises a frame support 503 and 4 shutter blades 505*a*-505*d*, where each shutter blade are controlled by a first actuator 507*a*-507*d* and a second actuator 509*a*-509*d*. The frame support 501 comprises a top plate 511 (shown in thick lines FIG. 5*b* and not shown in FIG. 5*c*) and a bottom plate 513. The shutter blades 505*a*-505*d* are positioned between the top plate 511 and bottom plate 513. The first and second actuators are pivotally mounted on the top plate using bearings, where only bearings 520*a* and 522*a* respectively related the first actuator 507*a* and the second actuator 509*a* are labeled in FIG. 5*b*. The actuators are arrange in a hole in the top plate and can rotate in relation to the top plate in a manner as described in FIGS. 6*a* and 6*b*. The shutter blades are also pivotally connected to the top plate using a bearing 524*a*-524*d* and a mechanical arm system as described in FIGS. 6*a* and 6*b*. The top plate 511 and bottom plate 513 are interconnected by a number of spacers 514 (not shown in FIGS. 5*b* and 5*c*). The bottom plate 513 comprises an aperture 516 where through a light beam can pass when the framing system is positioned in a light fixture generating a light beam. The skilled person realizes that the top plate also comprises an aperture 518, but that this is larger than the aperture of the bottom plate. The first actuator 507*a*-507*d* related to each shutter blade is adapted to rotate the shutter blade around a first rotational point 517*a*-517*d* and the second actuator 509*a*-509*d* related to each shutter is adapted to move the first rotational point 517*a*-517*d* in relation to the light beam. The fundamentals of the mechanical systems used to move the shutter blades of the framing system illustrated in FIG. 5*a*-5*c* are described in further detail in FIGS. 6*a* and 6*b*.

The shutter blades are in this embodiment merged in a pile such at each shutter blade overlaps a part of a second shutter blade and such that a part of the shutter blade is overlapped by a part of another shutter blade. However, the person skilled in the art realizes that it is possible to position the shutter in two or more planes instead of merging the shutter blades. The frame support 503 comprises also a mechanical stop 519*a*-519*d* for each shutter blade. The mechanical stop is adapted to limit the movements of the shutter blades and prevents the shutter blades form moving into a position were the shutter blades can move out of their mutual positions.

The top plate comprises also blade tensioning means providing tension to the shutter blades whereby the shutter blades are hereby squeezed together and kept in substantially the same plane. Displacement of the shutter blades, for instance due to thermal expansion of the shutter blades, is hereby avoided. The blade tensioning means (not shown in FIGS. 5*b* and 5*c*) are embodied as a number of tensioning arms 530 (only one labeled) connected to the top plate 511 at one end and to a tensioning ring 532 at a second end. The shutter blades are positioned between the tensioning ring 532 and the bottom plate 513 and the tensioning arms pushes the shutter blade towards to bottom plate by providing force to the shutter blades (through the tensioning ring). Tension is hereby provided to the shutter blades and the tensioning ring reduces displacement of the shutter blades in a direction along the light beam. This ensures that a sharp image of the light beam can be provided at a target surface along the light beam for instance by focusing the shutter blades using an optical system as known in the art of projecting light fixtures.

Figure 6A:
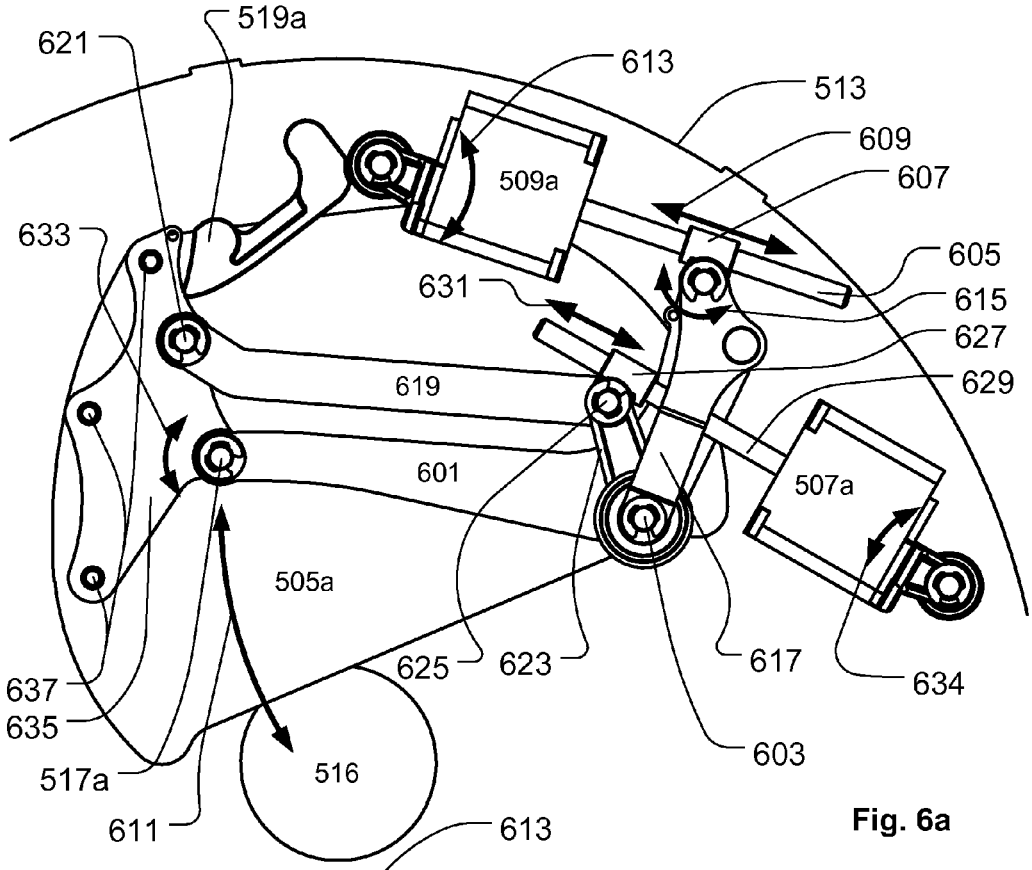
FIG. 6*a* and FIG. 6*b* illustrates respectively a top view and perspective view of a single shutter blade used in the embodiment shown in FIG. 5*a*-5*c;*
Figure 6B:
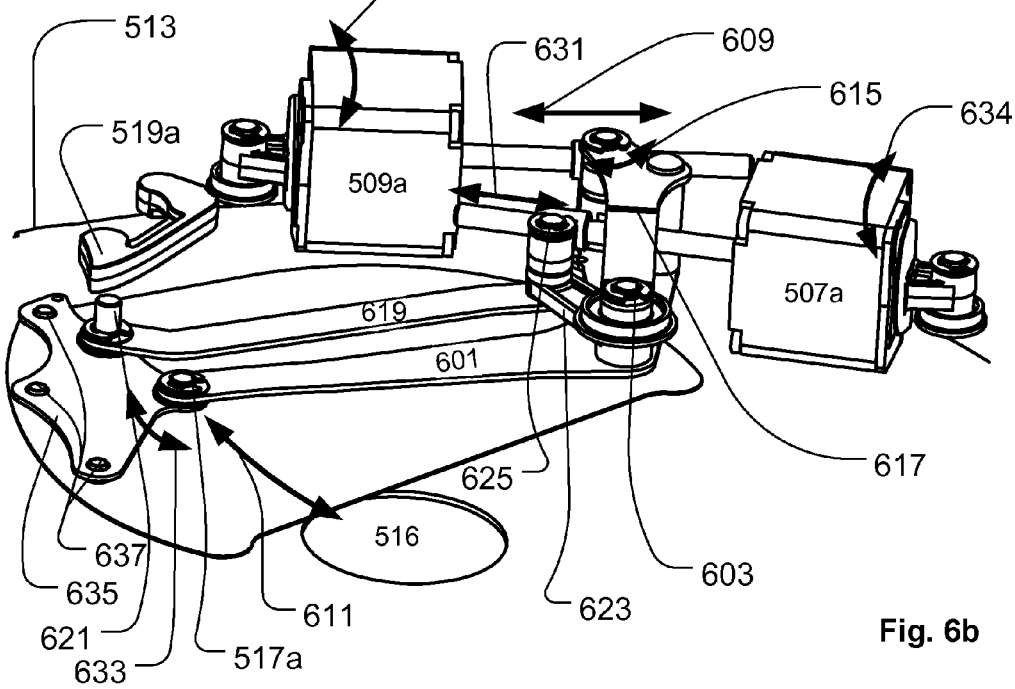

FIG. 6*a* and FIG. 6*b* illustrates respectively a top view and perspective view of a single shutter blade 505*a* and its corresponding mechanics.

The shutter blades 505*a* comprise in the illustrated embodiment an approximately L-shaped first arm 601 where a first leg is pivotally connected to the first rotational point 517*a* and the corner end is pivotally connected to the top plate 513 at a frame pivot point 603 (using bearing 524*a* in FIG. 5*a*-5*c*). The second actuator 509*a* comprises a rotatable spindle 605 and the second end of the L-shaped arm is connected to the rotatable spindle through a threaded cylinder 607. The threaded cylinder will move along the rotatable spindle 605 as illustrated by arrow 609 when the second actuator rotates the spindle. This will cause the L-shaped arm 601 to rotate around the frame pivot point 603 and the first rotational point 517*a* will rotate as indicated by arrow 611 and thus move in relation the light beam. The threaded cylinder 607 is pivotally connected to the second leg of the L-shaped arm and the second actuator 509*a* is pivotally connected the top plate in order to eliminate the mismatch between linear movement of the threaded cylinder along the spindle and the rotation of the L-shaped arm. The second actuator will thus rotate in relation to the top plate as illustrated as illustrated by arrow 613 and the threaded cylinder will rotate in relation the L-shaped arm as illustrated by arrow 615. The second leg of the L-shaped arm comprises an upper bridge 617 which is mounted on a number of spacers and connected to the frame pivot point 603. The upper bridge serve to strengthen the second leg of the L shaped arm.

The shutter blade 505*a* comprises also a second arm having a first part 619 pivotally connected to the shutter blade at a blade pivot point 621 and a second part 623 pivotally connected the top plate at the frame pivot point 603. The first part 619 and a second part 623 are pivotally interconnected at an arm pivot point 625. The arm pivot point comprises a threaded cylinder 627 connected the rotatable spindle 629 of the first actuator 507*a*. The second actuator 509*a* is thus adapted to move the threaded cylinder 627 of the arm pivot point as illustrated by arrow 631. The first part 619 of the second arm will as a consequence push/pull the blade pivot point 621 in relation to the first rotational point causing the shutter blade 505*a* to rotate around the first rotational point 517*a* as illustrated by arrow 633. The second actuator 509*a* is like the first actuator pivotally connected to the top plate and can pivot as indicated by arrow 634 in order to eliminate the mismatch between linear are movement and rotational transitions in the mechanical system.

The shutter blade comprises further an overhang 635 which is elevated from the shutter blade 505*a* by a number of spacers 637. The first rotational point 517*a* and the blade pivot point 621 are positioned at the overhang 637. The result is that a neighboring shutter blade can move into the area beneath the overhang whereby the degree of freedom of the shutter blades is increased. The overhang is illustrated as one single overhang to which both the blade pivot point and the first rotational point is connected. The person skilled in the art realizes that it is possible to provide a single overhang for each pivot point.

The length of the first part of said second arm is substantially equal to length of the first arm and the length of the second part of the second arm is substantially equal to the distance between the blade pivot point and the first rotational point. The first rotational point, blade pivot point, frame pivot point and arm pivot point constitutes thus the corners of a parallelogram.

Figure 7:
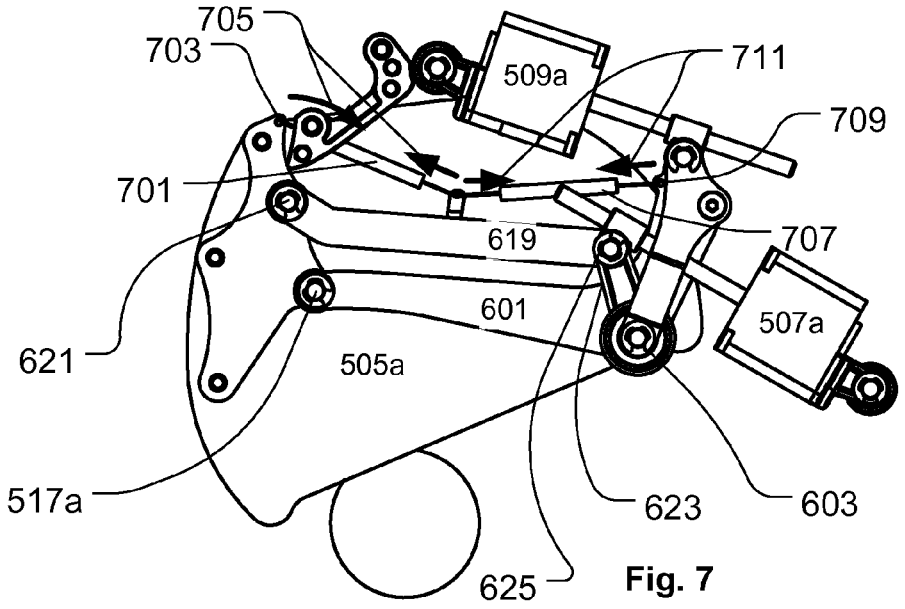
FIG. 7 other possible features of a single shutter blade used in the framing system shown in FIG. 5*a*-5*c;*

FIG. 7 illustrates another possible feature of the framing system shown in FIG. 5*a*-5*c* and illustrates a top view of a single shutter blade 505*a*. The shutter blade 505*a* comprises in this embodiment first tensioning means 701 connected to the second arm 619 and to the shutter blade at a point 703 offset the blade pivot point 621 where the second arm is connected to the shutter blade. The first tensioning means is adapted to tension the shutter blade and second arm in relation to each in order to eliminate play is the mechanical system. The tensioning means can either push the shutter blade and second arm away from each other or pull them together around the blade pivot point. The tensioning means can be any kind of means providing tension between the shutter blade and the second arm for instance a spring or elastic band. The first tensioning means can alternatively be embodied as a rotational spring integrated into the bearings of the blade pivot point. The first tensioning means 701 pulls in the illustrated embodiment the second arm and the shutter blade together as indicated by the arrows 705. The shutter blade comprises also second tensioning means 707 connected to the second arm 619 and to the first arm 601 at a point 709 offset the first rotational point where the first arm is connected to the shutter blade. The second tensioning means 707 pulls in the illustrated embodiment the second arm and the first arm as indicated by the arrows 711 and eliminated thereby play related to the first rotational point 517*a*. The second tensioning means can also be embodied as a rotational spring integrated into the frame blade pivot point.

The length of the first part 619 of the second arm substantially equals the length of the first arm 601 and in that the length of the second part 623 of the second arm substantially equals the distance between the blade pivot point and the first rotational point. The first arm 601, first part 619 of the second arm, the second arm 623 of the second arm and the distance between the blade pivot point and first rotational point constitutes thus a substantial parallelogram, where the first rotational point 517*a*, blade pivot point 621, arm pivot point 625 and frame pivot point 603 constitutes the corners of the parallelogram. The consequence is that the angle of the shutter blade in relation the light beam (aperture) will not change during movement of the first rotational point 517*a*. The control system controlling the movement of the shutter blades can in this way be simplified as the first actuator does not need to compensate for the change in angle of the shutter blade in relation to the light beam when the second actuator moves the rotational point in relation the lighten beam. This is achieved as the frame pivot point 603 and the arm pivot point 625 is fixated in relation to each other during rotation of the first arm 601 if the first actuator is not moved. The first rotational point 517*a* and the blade pivot point 621 are, due the properties of the parallelogram, also fixated in relation to each other and the shutter blade will thus not rotate in relation to the light beam if the first arm and the first part of the second arm are rotated. A linear movement of the shutter blade will as a consequence appear inside the light beam.

The framing system can for instance be embodied in a framing system as described in our Danish pending patent application filed Sep. 11, 2009 and having application number DK PA200901015 incorporated herein by reference. The patent application DK PA200901015 describes in short a framing system for shaping a light beam. The framing system comprises a base support rotatable supporting a frame support. The frame support comprises a number of shutter blades surrounding the light beam and a number of actuators adapted to move the shutter blades in and out of said light beam. The framing system comprises further rotatable electric connecting means, the rotatable electric connecting means enabling transferring of electric energy between the frame support and the base support during rotation of the frame support in relation to said base support. The bottom plate of the framing system disclosed in the present invention for instance be embodied as the base support of DK PA200901015 and the upper plate can be embodied as the frame support. The framing system according the present invention can thus be rotated more the 360 degrees around the light beam.

Figure 8:
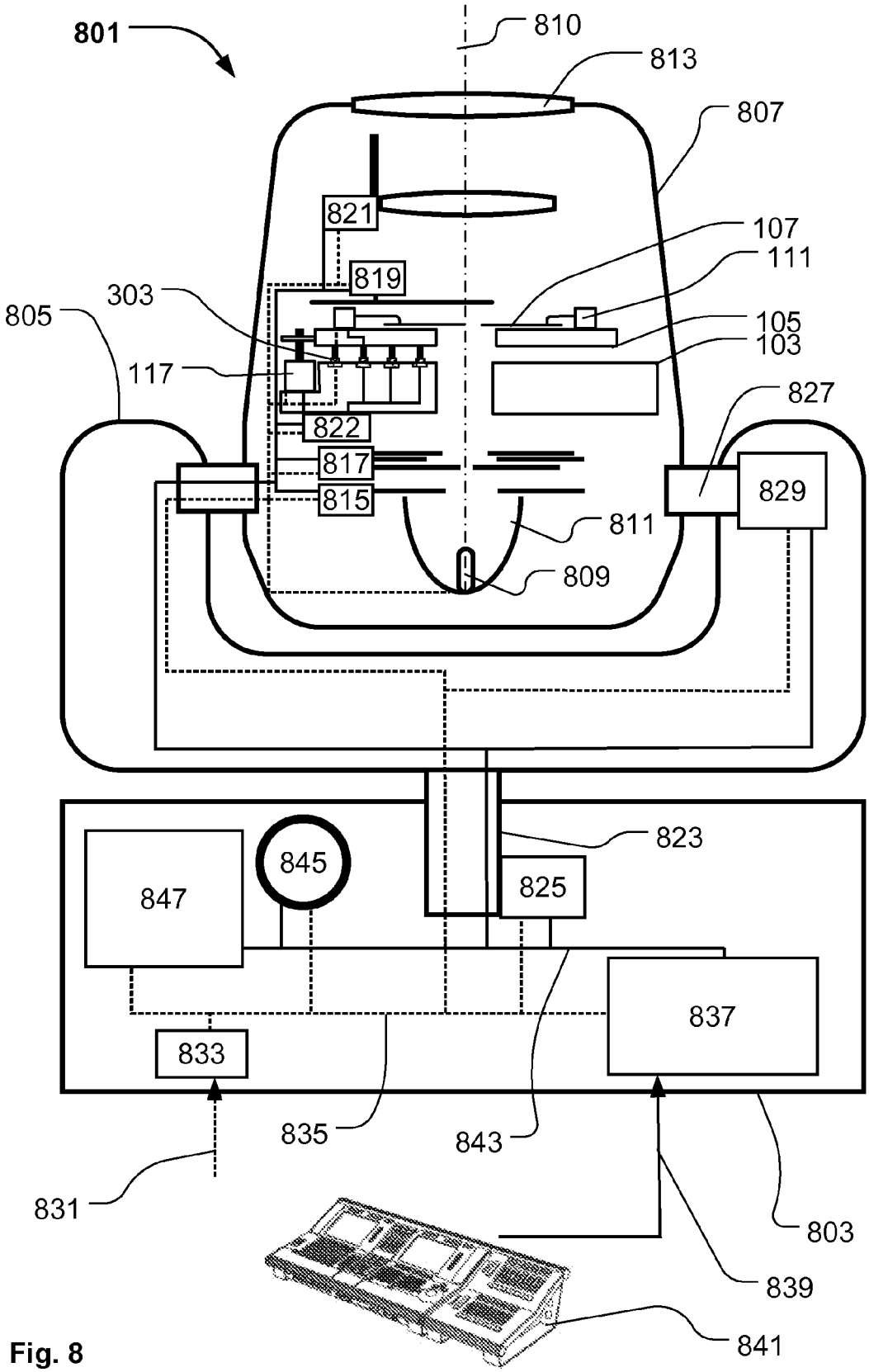
FIG. 8 is a structural diagram illustrating a moving head light fixture including a framing system according to the present invention.

FIG. 8 is a structural diagram illustrating a moving head light fixture 801 with a framing system according to the present invention. The framing system has further been integrated into the framing system according to our Danish patent application DK PA200901015. The moving head light fixture 801 comprises a base 803 connected to a yoke 805 and a head 807 carried in the yoke. The head comprises at least one light source 809 which generates a light beam (not shown) propagating along an optical axis 810. The light beam is reflected by a reflector 811 and passes through a number of light effects before exiting the head through a lens 813. The light effects could for instance be any light effects known in the art of intelligent lighting for instance a dimmer 815, a CMY color mixing system 817, color filters (not shown), gobos 819 and/or a zoom system 821.

One light effect is a framing system according to the present invention. The framing system comprises a base support 103 rotatable supporting a frame support 105 and an actuator 117 adapted to rotate the frame supports described in DK PA200901015. The frame support comprises a number of shutter blades 107 surrounding an aperture, through which the light beam passes and number of actuators 111 are adapted to move the shutter blades in and out of the aperture and thus also in and out of the light beam the light beam as described in FIG. 1-7. The framing system comprises also controlling means 822 adapted to control the framing system based on a received control signal as described below. The framing system comprises also a number of rotatable electric connecting means 303 for transferring power and controls signals from the base support to the frame support.

The light source can be any known light sources e.g. discharge lamps, LEDs, OLEDS, plasma lamps, lasers etc. The reflector can be any kind of reflectors and in some applications also be embodies as optical lenses such as TIR lenses. It is also possible to include a multiple number of light sources and mixing the light from these light sources into a light beam.

The moving head light fixture comprises first rotating means for rotating the yoke in relation to the base, for instance by rotating a shaft 823 connected to the yoke by using a motor 825 positioned in the base. The moving head light fixture comprises also second rotating means for rotating the head in relation to the yoke, for instance by rotating a shaft 827 connected to the head by using a motor 829 positioned in the yoke. The skilled person would realize that the rotation means could be constructed in many different ways using mechanical components such as motors, shafts, gears, cables, chains, transmission systems etc.

The moving head light fixture receives electrical power 831 from an external power supply (not shown). The electrical power is received by an internal power supply 833 which adapts and distributes electrical power through internal power lines 835 (dotted lines) to the subsystems of the moving head. The internal power system can be constructed in many different ways and the illustrated power lines is for simplicity illustrated as one system where all subsystems are connected to the same power line. The skilled person would however realize that some of the subsystems in the moving head need different kind of power and that a ground line also can be used. The light source will for instance in most applications need a different kind of power than step motors and driver circuits.

The light fixture comprises also a controller 837 which controls the other components (other subsystems) in the light fixture based on an input signal 839 indicative of at least one light effect parameter and at least one position parameter. The controller receives the input signal from a light controller 841 as known in the art of intelligent and entertainment lighting for instance by using a standard protocol like DMX, ArtNET, RDM etc. The light effect parameter is indicative of at least one light effect parameter of said light beam for instance the amount of dimming and/or the dimming speed of the light beam, a color that the CMY system 817 should mix, the kind of color filter that a color filter system (not shown) should position in the light beam and/or the kind of gobo that the gobo system 819 should position in the light beam, the divergence of the light beam that light fixture should create using a zoom system 821, a focus distance that indicate the distance form the lens to a surface where a gobo effect should be imaged, etc.

The light effect parameter can also be indicative of how the framing system should frame the light beam and can therefore comprises information of how each shutter blade should move in relation to the light beam, how the frame support should be rotated in relation the base support. The controller 837 receives the light parameter and sends commands to the controlling means 822 adapted to control the framing system. The controlling means 822 adapted to control the framing system will then instruct the actuators to activate the relevant parts as instructed and the descried framing effect is achieved.

The controller is adapted to send commands and instructions to the different subsystems of the moving head through internal communication lines 843 (solid lines). The internal communication system can be based on a various type of communications networks/systems and the illustrated communication system is just one illustrating example.

The position parameter is indicative of rotation of at least said yoke in relation to said base and/or rotation of said head in relation to said yoke. The position parameter could for instance indicate a position whereto the light fixture should direct the beam, the position of the yoke in relation to the base, the position of the head in relation to the yoke, the distance/angle that the yoke should be turned in relation to the base, the distance/angle that the head should be turned in relation the base etc. The rotation parameter could also indicate the speed and time of the rotation.

The moving head could also have user input means enabling a user to interact directly with the moving head instead of using a light controller 841 to communicate with the moving head. The user input means 845 could for instance be bottoms, joysticks, touch pads, keyboard, mouse etc. The user input means could also be supported by a display 847 enabling the user to interact with the moving head through menu system shown on the display using the user input means 847. The display device and user input means could in one embodiment also be integrated as a touch screen.

The present invention relates also to a method for shaping a light beam using a framing system comprising a frame support comprising a number of shutter blades surrounding the light beam and a number of actuators adapted to move said shutter blades in and out of said light beam. The method comprises the step of said method comprises the step of:

moving at least one of said shutter blade in and out of said light beam using said actuator;

where the said step of moving the at least one shutter blade comprises the steps of:

rotating said shutter blade around a rotation point using a first actuator and;

moving said rotation point in relation to said light beam using a second actuator.

The framing system comprises in a further embodiment also a base support where the frame support is rotatable connected to the base support the method comprises in this embodiment the steps of:

rotating the shutter blades around blade around the light beam by rotating said frame support in relation the base support;

where the step of rotating the shutter blade around the light beam comprises the steps of rotating the frame support at least 360 degrees and transferring electric energy between said frame support and said base support. It is hereby achieved that several light effects can be created as the shape of the light beam can be changes and continuously/endless rotated.

The invention claimed is:

1. A framing system for shaping a light beam, said framing system comprises a frame support, said frame support comprises:

a number of shutter blades surrounding said light beam;

a number of actuators adapted to moved said shutter blades in and out of said light beam;

said shutter blades form a merged pile, where at least a part of a first shutter blade is in placed over at least a part of a second shutter blade and where at least a part of said shutter blade is placed below a at least a part of a third shutter blade, wherein a first of said actuators rotates at least one said shutter blades in relation to a first rotational point and in that a second of said actuators moves said first rotational point in relation to said light beam.

2. A framing system according to claim 1, wherein said at least one shutter blade comprises a first arm pivotally connected to said first rotational point and pivotally connected to said frame support at a frame pivot point and in that said second actuator moves said first rotational point by pivoting said first arm around said frame pivot point.

3. A framing system according to claim 1, wherein said at least one shutter blade comprises a second arm pivotally connected to said shutter blade at a blade pivot point offset said first rotational point and in that said first actuator rotates said shutter blade by interacting with said second arm.

4. A framing system according to claim 3, wherein said second arm comprises a first part and a second part pivotally interconnected at an arm pivot point where said first part is pivotally connected to said blade pivot point and said second part is pivotally connected to said frame pivot point and in that said first actuator rotates said shutter blade by moving said arm pivot point in relation to said frame pivot point.

5. A framing system according to claim 4, wherein the length of said first part of said second arm substantially equals the length of said first arm and in that the length of said second part of said second arm substantially equals the distance between said blade pivot point and said first rotational point.

6. A framing system according to claim 4, comprising first tensioning means and second tensioning means providing a torque to least two of:

said first rotational point;

said blade pivot point;

said frame pivot point or said arm pivot point.

7. A framing system according to claim 3, wherein said at least one shutter blade comprises at least one overhang and in that said blade pivot point is positioned at said at least one overhang.

8. A framing system according to claim 1, wherein said at least one shutter blade comprises at least one overhang and in that said first rotational point is positioned at said at least one overhang.

9. A framing system according to claim 1 further comprising blade tensioning means adapted to squeeze said shutter blades together.

10. A framing system according to claim 1 further comprising a base support rotatable supporting said frame support.

11. A framing system according to claim 10 wherein that said framing system comprises rotatable electric connecting means, said rotatable electric connecting enabling transferring of electric energy between said frame support and said base support during rotation of said frame support in relation to said base support.

12. A method for shaping a light beam using a framing system, said framing system comprises a frame support, said frame support comprises:

a number of shutter blades surrounding said light beam;

a number of actuators adapted to moved said shutter blades in and out of said light beam;

said shutter blades form a merged pile, where at least a part of a first shutter blade is in placed over at least part of a second shutter blade and where at least a part of said first shutter blade is placed below a at least a part of a third matter blade;

said method comprises the step of:

moving at least one of said shutter blade in and out of said light beam using said actuator;

wherein said step of moving said at least one shutter blade comprises the step of:

rotating said shutter blade around a rotation point using a first actuator and;

moving said rotation point in relation to said light beam using a second actuator.

13. A method for shaping a light beam according to claim 12 wherein said framing system also comprises a base support rotatable supporting said frame support, said method comprises the steps of:

rotating said shutter blades around blade around said light beam by rotating said frame support;

where said step of rotating said shutter blade around said light beam comprises the steps of:

rotating said frame support at least 360 degrees and transferring electric energy between said frame support and said base support.

* * * * *